US005314399A

United States Patent [19]

Suzuki

[11] Patent Number: 5,314,399

[45] Date of Patent: May 24, 1994

[54] SEDIMENTATION CENTRIFUGE WITH HELICAL FINS MOUNTED ON THE SCREW CONVEYOR

[75] Inventor: Souroku Suzuki, Mobara, Japan

[73] Assignee: Kotobuki Techrex Ltd., Kawasaki, Japan

[21] Appl. No.: 13,249

[22] Filed: Feb. 3, 1993

Related U.S. Application Data

[63] Continuation of Ser. No. 748,207, Aug. 20, 1991, abandoned.

[51] Int. Cl.[5] ..... B04B 1/20

[52] U.S. Cl. ..... 494/54; 494/53; 210/380.3

[58] Field of Search ..... 494/43, 52-56, 494/66-68; 210/360.1, 369, 377, 380.1-380.3, 389

[56] References Cited

U.S. PATENT DOCUMENTS

| | | | |
|---|---|---|---|
| 1,648,790 | 11/1927 | Sturgeon | 494/53 X |
| 1,970,693 | 8/1934 | Fischer | 494/53 X |
| 2,057,156 | 10/1936 | Lyons . | |
| 2,622,794 | 12/1952 | Smith | 494/53 |
| 2,625,320 | 1/1953 | Lyons | 494/54 X |
| 2,837,272 | 6/1958 | Laguilharre | 494/53 X |
| 3,228,593 | 1/1966 | Topping | 494/53 |
| 3,322,336 | 5/1967 | Lohse et al. | 494/53 |
| 3,623,656 | 11/1971 | Lavanchy | 494/52 X |
| 3,741,466 | 6/1973 | Weiland | 494/52 X |
| 4,009,823 | 3/1977 | Nozdrovsky | 494/53 X |
| 4,042,172 | 8/1977 | Nozdrovsky | 494/53 |
| 4,209,128 | 6/1980 | Lyons | 494/53 X |
| 4,335,846 | 6/1982 | Shapiro | 494/54 |
| 4,617,010 | 10/1986 | Epper et al. | 494/52 |
| 4,729,830 | 3/1988 | Suzuki | 210/380.3 |
| 5,182,020 | 1/1993 | Grimwood | 494/53 X |

FOREIGN PATENT DOCUMENTS

| | | | |
|---|---|---|---|
| 0228188 | 7/1987 | European Pat. Off. . | |
| 193997 | 1/1908 | Fed. Rep. of Germany | 494/66 |
| 933380 | 9/1955 | Fed. Rep. of Germany | 494/67 |
| 1026692 | 3/1958 | Fed. Rep. of Germany | 494/58 |
| 1086633 | 8/1960 | Fed. Rep. of Germany | 210/380.3 |
| 1279551 | 10/1968 | Fed. Rep. of Germany . | |
| 50-54961 | 5/1975 | Japan . | |
| 542409 | 2/1979 | Japan | 494/53 |
| 62-152556 | 7/1987 | Japan . | |
| 425656 | 4/1974 | U.S.S.R. | 494/53 |
| 553001 | 4/1977 | U.S.S.R. | 494/53 |
| 456353 | 11/1936 | United Kingdom | 494/54 |
| 778574 | 7/1957 | United Kingdom . | |

*Primary Examiner*—Harvey C. Hornsby
*Assistant Examiner*—Charles Cooley
*Attorney, Agent, or Firm*—Flynn, Thiel, Boutell & Tanis

[57] ABSTRACT

A sedimentation centrifuge includes a bowl which is supplied with a feed mixture, i.e., a solid-liquid mixture, from a supply pipe. When the bowl rotates at high speed, heavy solids are displaced radially outwardly toward and sedimented on the inner wall surface of the bowl. The solid particles are then discharged through a discharge hole of the bowl and an outlet passage by a screw conveyor in the bowl. During rotation of the bowl, fins on the screw conveyor assist in separating the liquid into heavy and light liquid phases with increased separation efficiency. The separated heavy and light liquids are separately discharged from the bowl through respective outlet passages.

3 Claims, 2 Drawing Sheets

SEDIMENTATION CENTRIFUGE WITH HELICAL FINS MOUNTED ON THE SCREW CONVEYOR

This application is a continuation of U.S. patent application Ser. No. 07/748,207, filed Aug. 20, 1991, now abandoned.

BACKGROUND OF THE INVENTION

1. Field of the Invention

The present invention relates to a sedimentation centrifuge for separating a mixture of solid particles and liquids into solid and liquid phases, and more particularly to a sedimentation centrifuge for separating a mixture of solid particles and two liquid phases, i.e., heavy and light liquids, into the solid particles, the heavy liquid, and the light liquid.

2. Description of the Prior Art

Heretofore, centrifuges or centrifugal separators are used to separate a mixture of solid particles and liquids into solid and liquid phases, or a mixture of solid particles and heavy and light liquids into the solid particles, the heavy liquid, and the light liquid.

Disk decanters (also called cone-disk decanters) which are in general use for centrifugal sedimentation have a number of spaced conical disks in the form of truncated cones. When a feed slurry of solid-liquid mixture with a large solid content is separated by a disk decanter, however, accumulated solid particles in the mixture tend to clog the gaps between the disks, making the disc decanter fail to operate. To prevent such a problem from happening, it is necessary to reduce the amount of solid particles contained in the mixture with, for example, a screw decanter, and then separate the mixture into solid and liquid phases with a disk decanter. However, this practice requires two expensive decanters connected in series with each other. Furthermore, since the mixture has to be processed under intensive centrifugal force twice, the energy consumed by the decanters is relatively large and wasteful The inventor has proposed a sedimentation centrifuge for separating a mixture of solid particles and liquids into solid and liquid phases, and also a sedimentation centrifuge for separating a mixture of solid particles and two liquid phases, i.e., heavy and light liquids, into the solid particles, the heavy liquid, and the light liquid, as disclosed in Japanese Patent No. 1,007,732 (Japanese Patent laid-Open No. 054961/75) and Japanese Patent Laid-Open No. 152556/87. The proposed sedimentation centrifuges, which may be termed doubly-canted screw decanters, have a frustoconical bowl for discharging sedimented solid particles. The bowl has an inner wall surface that is canted with respect to the central axis of the bowl first at a larger angle and then at a smaller angle along the direction in which the accumulated solids are discharged. The doubly-canted inner wall surface of the bowl allows the solids to travel smoothly to the end of the bowl and also allows liquid to be removed smoothly from the solid particles. The bowl structure also serves to increase the amount of feed that stays in the centrifuge for an increased period of time. Therefore, the separation accuracy of the centrifuge and the processing capacity of the centrifuge per unit time are increased.

The inventor has found that much remains to be improved in terms of the processing capacity, the separation accuracy, and the amount of required energy in the practical application of the centrifuges. More specifically, as described above, the disk decanter often fails to operate because sedimented solids tend to clog the gaps between the disks particularly when the feed has a large solid content. This trouble can only be avoided by first reducing the solid content in the slurry with the screw decanter and then processing the slurry with the disk decanter. Therefore, the two expensive decanters or centrifuges need to be connected in series with each other, resulting in a wasteful consumption of energy as intensive centrifugal forces are required to be applied twice in the decanters. While the doubly-canted screw decanters proposed by the inventor can finish the separating process when the slurry passes through the centrifuge only once, the actual use of the proposed decanters has indicated that the proposed decanters are not so advantageous as expected over the series-connected centrifugal separators and need further improvement with respect to the processing capacity and the energy consumption in applications which demand accurate phase separation.

SUMMARY OF THE INVENTION

It is an object of the present invention to provide a sedimentation centrifuge which is free of failures due to clogging caused by a slurry or mixture with a large solid content, can separate a slurry with high separation accuracy, consumes a relatively reduced amount of energy, and can separate a relatively large amount of feed highly reliably in only a single cycle of application of centrifugal forces.

According to the present invention, there is provided a sedimentation centrifuge comprising a hollow cylindrical body rotatable about its own central axis, supply means for supplying a solid-liquid mixture into the hollow cylindrical body, a first hollow frusto-conical section having an inner wall surface inclined at a larger angle to the central axis, the first hollow frusto-conical section having a larger-diameter open end contiguously joined to one end of the hollow cylindrical body and a smaller-diameter open end axially opposite to the larger-diameter open end, a second hollow frusto-conical section having an inner wall surface inclined at a smaller angle to the central axis, the second hollow frusto-conical section having one open end contiguously joined to the smaller-diameter open end of the first hollow frusto-conical section and an opposite open end defining a discharge hole, the one open end being positioned at the same level as or below the free liquid surface of the solid-liquid mixture which is of a cylindrical shape in the hollow cylindrical body while the hollow cylindrical body is rotating, a screw conveyor disposed in the hollow cylindrical body and the first and second hollow frusto-conical sections for transferring sedimented solids separated from the solid-liquid mixture in the hollow cylindrical body through the first and second hollow frusto-conical sections to the discharge hole, bank means on an end of the hollow cylindrical body remote from the discharge hole for controlling an overflow of liquids separated from the solid-liquid mixture, discharge means for discharging the overflow of liquids, and at least one fin mounted on the screw conveyor and disposed in spaces between turns of the vane of the screw conveyor, the fin being inclined with respect to the central axis.

The bank means may comprise a first bank on an end of the hollow cylindrical body remote from the discharge hole for controlling an overflow of a heavy liquid separated from the solid-liquid mixture, and a second bank on an end of the hollow cylindrical body remote from the discharge hole, for controlling an overflow of a light liquid separated from the solid-liquid mixture The discharge means may discharge the overflows of heavy and light liquids, respectively. For the purpose of discharging liquids, a skimming method is also applicable.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
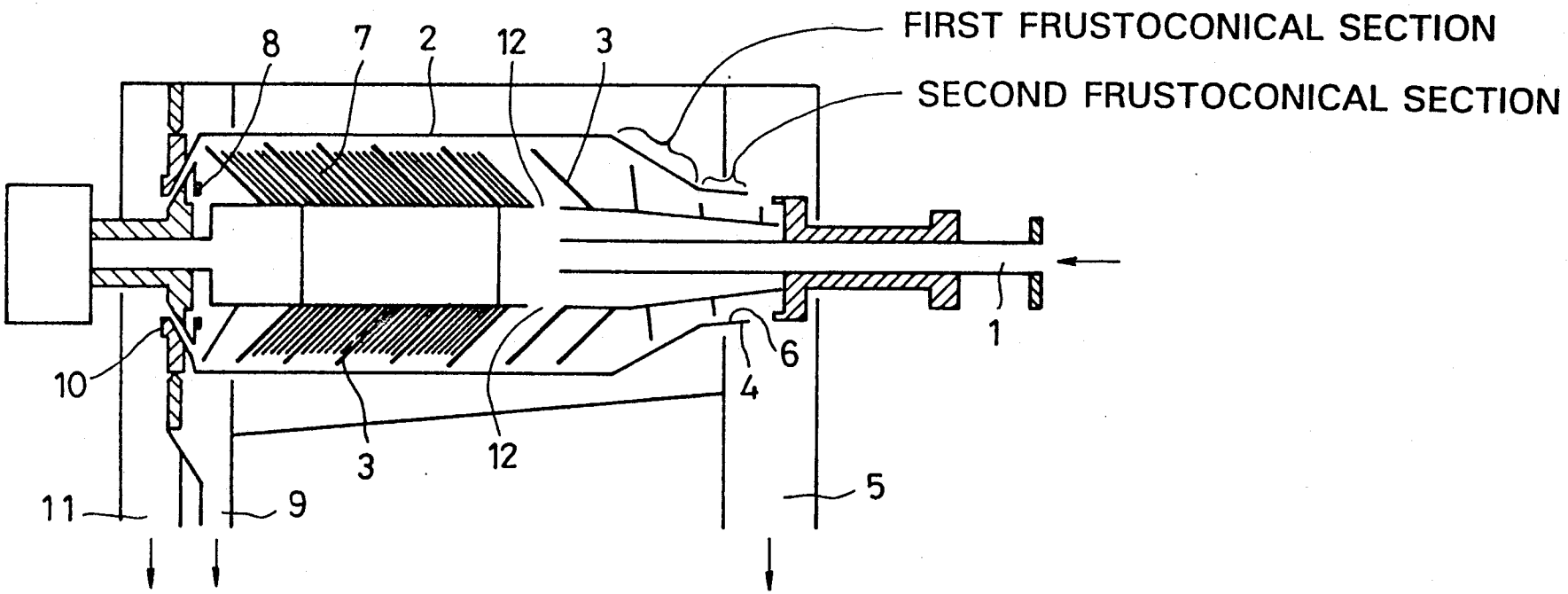
FIG. 1 is a schematic longitudinal cross-sectional view of a sedimentation centrifuge according to the present invention.

As shown in FIG. 1, the three-phase separator has a supply pipe 1 which extends axially into and is open in a large-diameter cylindrical section of a bowl 2 which comprises a hollow cylindrical body. A feed slurry or solid-liquid mixture to be separated, which is typically composed of solids and heavy and light liquids, is fed through the supply pipe 1 and holes 12 into the bowl 2 while the bowl 2 is rotating at high speed. Solid particles contained in the mixture are displaced radially outwardly toward the inner wall surface of the bowl 2 under centrifugal forces which are generated due to the high-speed rotation of the bowl 2.

The bowl 2 has an open discharge end 4 around the supply pipe 1, the open discharge end 4 defining a discharge hole. The bowl 2 houses a screw conveyor 3 which is disposed concentrically therein and extends axially between opposite ends of the bowl 2. The solid particles sedimented on the inner wall surface of the bowl 2 are transferred toward the discharge hole by the screw conveyor 3 which rotates at a speed different from the speed at which the bowl 2 is rotating. The solid particles are then discharged from the discharge hole through an outlet passage 5 out of the three-phase separator.

The bowl 2 has a doubly-canted portion disposed partly around one end portion of the screw conveyor 3 which is disposed around the supply pipe 1. The doubly-canted portion includes a first frusto-conical section whose inner wall surface is inclined at a larger angle to the central axis of the bowl 2 and which has a larger-diameter open end contiguously joined to one end of the cylindrical section of the bowl 2, and a second frusto-conical section which has a larger-diameter open end contiguously joined to a smaller-diameter open end of the first frusto-conical section and whose inner wall surface is inclined at a smaller angle to the central axis of the bowl 2. The larger-diameter open end of the second frusto-conical section is positioned at the same level as or below the free liquid surface or the free surface of the solid-liquid mixture which is of a cylindrical shape formed while the bowl 2 is rotating. The opposite open end of the second frusto-conical section serves as the discharge end 4.

The second frusto-conical section includes a beach 6 disposed near the discharge end 4 and positioned above the level of the mixture in the bowl 2.

Immediately before the sedimented solid particles reach the discharge end 4, the solid particles pass over the beach 6 where remaining liquid is substantially removed from the solids.

The three-phase separator also includes a plurality of helical fins 7 extending parallel to and positioned between the turns of the flight (vane) of the screw conveyor 3, the fins 7 being mounted on the screw conveyor shaft. The fins 7 are inclined with respect to the central axis of the bowl 2, i.e., the free liquid surface of the solid-liquid mixture of cylindrical shape in the bowl 2 during high-speed rotation thereof. A substantial portion of the mixture supplied to the separator flows along the flight of the screw conveyor 3 and the fins 7, and hence is subjected to resistance due to the friction therewith. Therefore, the mixture tends to flow in a region near the inner wall surface of the bowl 2 around the screw conveyor 3 and the fins 7. Since the region near the inner wall surface of the bowl 2 is spaced remotely from the axis about which the screw conveyor 3 and the fins 7 rotate, the mixture flowing in the region is subjected to large centrifugal forces, and can be separated highly efficiently.

The three-phase separator may have one or more helical fins and up to 20 helical fins. The distance between the radially outer tips of the fins and the inner wall surface of the bowl 2 ranges from 5 mm to 100 mm, and each of the fins has a thickness in the range of from 0.5 mm to 2 mm.

The distance between the fins should be as small as possible to reduce the distance that the particles of the mixture have to traverse, i.e., the sedimentation distance, resulting in an increase in the efficiency of sedimentation. If the distance between the fins were too small, the gaps between the fins would tend to be clogged by solid particles, preventing solids from being discharged from between the fins. Therefore, the distance between the fins should be determined depending on the nature of the solid-liquid mixture to be processed.

If the solid-liquid mixture has a larger solid content, then the distance between the radially outer tips of the fins and the inner wall surface of the bowl 2 should preferably be larger If the solid-liquid mixture has a smaller solid content, then the distance between the radially outer tips of the fins and the inner wall surface of the bowl 2 should preferably be smaller to give the fins an increased functional surface area for high separation efficiency.

It is therefore preferable that a plurality of screw conveyors with fins of different radial lengths be available, and one of the available screw conveyors be selected depending on the solid content of the solid-liquid mixture to be processed.

Since the centrifuge or the separator according to the present invention is of a doubly-canted decanter configuration, the distance between the free liquid surface of the mixture flowing through the bowl 2 and the inner wall surface of the bowl 2 is large. Therefore, the length of the fins which is inserted in the mixture in the bowl 2 is large for increased separation accuracy and capacity.

The angle by which the fins are inclined to the central axis of the bowl 2, i.e., the screw conveyor shaft, should preferably be small for reduced sedimentation distance and increased separation efficiency. If the angle were too small, however, the gaps between the fins would be clogged by solid particles, and solid particles would not be discharged from between the fins. The angle should preferably be in the range of from 30° to 85° degrees. The surface of the fins may be smooth or may have smooth radial grooves and ridges for an increased surface area that contributes to greater separation capability.

The fins for another embodiment may be in the form of a group of thin plates mounted on the screw conveyor shaft parallel thereto and extending radially outwardly from the screw conveyor shaft obliquely to the free surface of the mixture in the bowl 2 while it is rotating, and the screw conveyor vane may be wound on the outer edges of the thin plates.

Figure 2:
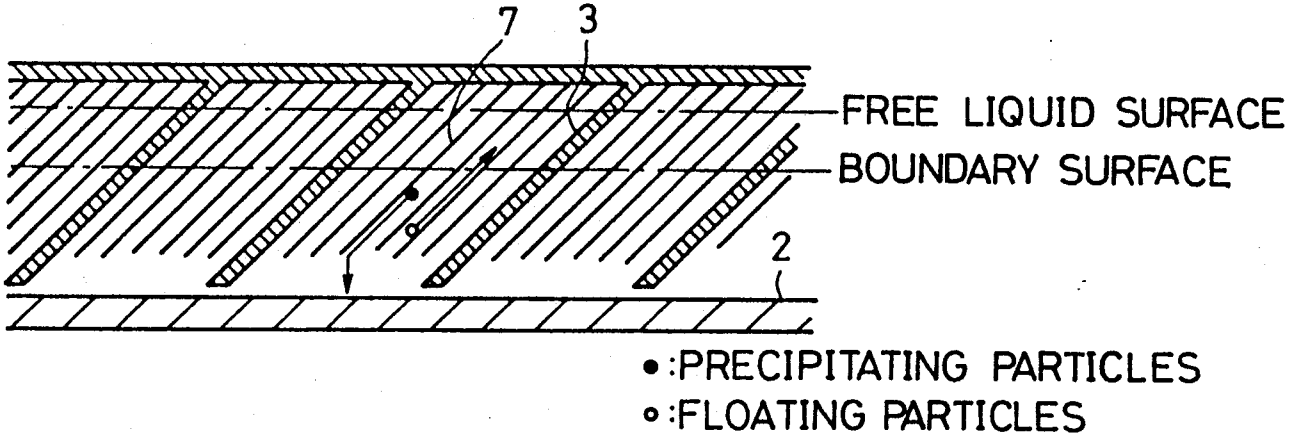
FIG. 2 is an enlarged fragmentary longitudinal cross-sectional view of fins and a screw conveyor in the sedimentation centrifuge shown in FIG. 1.

The centrifugal forces applied to the mixture in which the fins 7 are inserted are relatively small. Since, however, the distance between the fins 7 and also between the fins 7 and the screw conveyor vane, i.e., the sedimentation distance, is small, the sedimentation or swimming and subsequent coalescence of heavy and light particles in the mixture, such as precipitating particles and floating particles shown in FIG. 2, are promoted, resulting in increased separation accuracy. Particularly, if the mixture comprises solids and heavy and light liquids, then the heavy and light liquids can be separated with higher separation accuracy forming boundary surface as shown in FIG. 2, because of coalescence brought about by contact with the fins 7.

The light liquid which has been separated and has passed through the bowl 2 overflows a bank 8 and is discharged through an outlet passage 9 out of the separator. Likewise, the heavy liquid which has been separated and has passed through the bowl 2 overflows a bank 10 and is discharged through an outlet passage 11 of the separator. Thus, the banks 8, 10 serve to control the overflows of the light and heavy liquids.

FIG. 2 shows at enlarged scale the vane of the screw conveyor 3 and the fins 7. FIG. 2 also shows the manner in which sedimented and swinging particles move between the fins 7.

Figure 3:
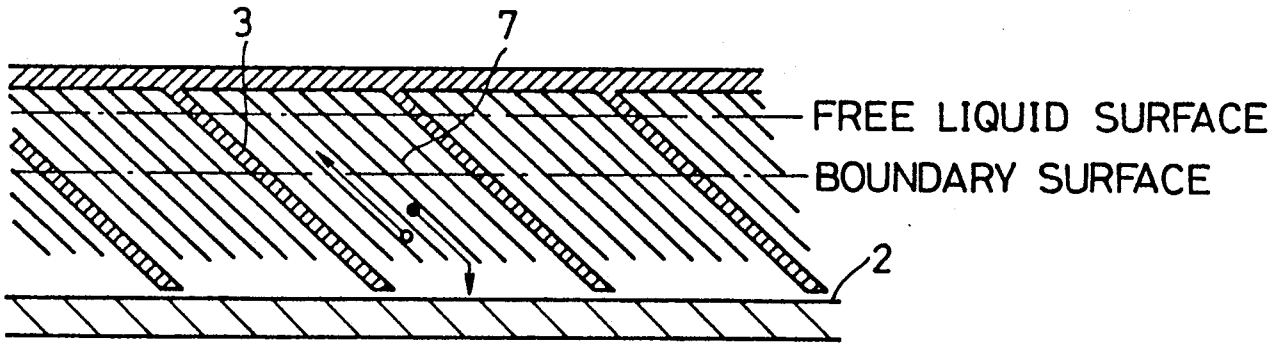
FIG. 3 is an enlarged fragmentary longitudinal cross-sectional view of fins and a screw conveyor according to another embodiment of the present invention

FIG. 3 shows a screw conveyor 3 and fins 7 according to another embodiment. The vane of the screw conveyor 3 and the fins 7 are inclined at an angle different from the angle at which, i.e., in a direction opposite to the direction in which, the screw conveyor vane and the fins 7 shown in FIG. 2 are inclined.

For another embodiment, it is preferable to arrange fins in the form of a group of thin plates mounted on the screw conveyor shaft parallel thereto and extending radially outwardly from the screw conveyor shaft obliquely to the free liquid surface of the mixture in the rotating bowl 2, and a screw conveyor vane is wound on the outer edges of the thin plates.

Now, comparative Examples 1 and 2 in which conventional decanters were used to separate a feed mixture, and Inventive Example in which the three-phase separator according to the present invention was used to separate a feed mixture will be described below.

COMPARATIVE EXAMPLE 1

1000 l/h of a feed mixture to be separated were produced from sardines by a screw press in a fish meal plant and passed through a rotary screen. The feed mixture was composed of 30.8 vol.% of oil, 61.5 vol.% of water, and 7.7 vol.% of solids. The feed mixture was supplied to a conventional singly-canted three-phase separation decanter having a bowl with an inside diameter of 250 mm. The feed mixture was separated under centrifugal forces of 3000 G at 95° C., into a light liquid composed of 2.5 vol.% or less of water, 2.0 vol.% or less of solids, and the remainder of oil, a heavy liquid composed of 98.7 vol.% of water, 1.3 vol.% of solids, and 0.83 wt.% of oil, and a cake composed of about 70 wt.% of water, 3.0 wt.% of oil, and the remainder of solids.

The light liquid was polished by a cone-disk decanter, for sale as fish oil. The heavy liquid was concentrated into a protein concentrate. The cake was dried by a drier.

The water content in the light liquid produced by the conventional three-phase separation decanter was 1.8 vol.% on average, which was a large value. The solids in the light liquid which were sedimented under centrifugal forces were 2.0 vol.%, which was also a large value. The light liquid was not available immediately as a fish oil product. The oil in the heavy liquid was 0.83 wt.% and the solids in the heavy liquid which were sedimented under centrifugal forces were 1.3 vol.%. These values were also large, and the heavy liquid caused blocking of heater pipes when it was concentrated.

The conventional three-phase separation decanter would not be practically usable as a three-phase separator if the feed mixture were processed only once by the three-phase separation decanter. To make the produced light liquid available as a fish oil product, it is necessary to subsequently polish the light liquid with a cone-disk decanter. The produced heavy liquid is responsible for causing trouble with heater pipes when it is concentrated.

COMPARATIVE EXAMPLE 2

3000 l/h of a feed mixture to be separated were produced from sardines by a screw press and passed through a rotary screen. The feed mixture was composed of 15.6 to 31.5 vol.% of oil, 3.2 to 12.1 vol.% of solids, and the remainder of water. The feed mixture was supplied to a conventional doubly-canted three-phase separation decanter having a bowl with an inside diameter of 320 mm and a screw conveyor shaft with no fins. The feed mixture was separated under centrifugal forces of 3000 G at 90° C., into a light liquid composed of 0.15 wt.% of water, a trace of solids, and the remainder of oil, a heavy liquid composed of 0.1 to 0.26 wt.% of oil, 0.3 vol.% of solids, and the remainder of water, and a cake composed of 1.8 wt.% of oil, about 65 wt.% of water, and the remainder of solids.

The light liquid was of such good quality that it could immediately be shipped as a fish oil product. The heavy liquid and the cake were processed in the same manner as with comparative Example 1. The protein concentrate produced from the heavy liquid did not cause blocking of heater pipes upon concentration, and hence was of better quality than the protein concentrate in Comparative Example 1. The cake was dried more quickly than the cake in the Comparative Example 1.

INVENTIVE EXAMPLE 5100 l/h of the feed mixture used in Comparative Example 2 was supplied to the three-phase separator according to the present invention. The three-phase separator used had a bowl with an inside diameter of 320 mm and a screw conveyor including six fins with distal ends spaced 20 mm from the inner wall surface of the bowl. The fins had a height of 70 mm on the screw conveyor shaft, were inclined at an angle of 45° as shown in FIG. 2, and disposed at equally spaced intervals between turns of the screw conveyor vane which were spaced 60 mm from each other. The feed mixture was separated under centrifugal forces of 3000 G at 93° C., into a light liquid composed of 0.12 wt.% of water, a trace of solids, and the remainder of oil, a heavy liquid composed of 0.1 to 0.2 wt.% of oil, 0.3 vol.% of solids, and the remainder of water, and a cake composed of 1.8 wt.% of oil, about 65 wt.% of water, and the remainder of solids.

The light liquid was of such good quality that it could immediately be shipped as a fish oil product. The heavy liquid and the cake were processed in the same manner as with Comparative Example 2. The protein concentrate produced from the heavy liquid was as good as the protein concentrate in Comparative Example 2. The cake was dried more quickly than the cake in the Comparative example 2.

The three-phase separator used in Inventive Example had major dimensions which were essentially the same as those of the doubly-canted three-phase separation decanter used in Comparative Example 2. Because of the fins provided in the screw conveyor, however, the processing capacity of the three-phase separator in Inventive example was 1.7 times that of the doubly-canted three-phase separation decanter in Comparative Example 2 (5100 l/h versus 3000 l/h), and the fish oil as the light liquid and a dilute aqueous solution of the protein concentrate as the heavy liquid had higher purity than those of Comparative Example 2 (the water in the light liquid: 0.12 wt.% versus 0.15 wt.%, and the oil in the heavy liquid: 0.1 to 0.2 wt.% versus 0.1 to 0.26 wt.%).

It was speculated that the presence of the fine 7 would adversely affect the stability of the dynamic interfacial boundary between the light and heavy liquids. However, the experimental results of Inventive and Comparative Examples indicated above show that the improved qualities of the separated light and heavy liquids proved the existence of a stable dynamic interfacial boundary between the light and heavy liquids.

Although certain preferred embodiments of the present invention have been shown and described in detail, it should be understood that various changes and modifications may be made therein without departing from the scope of the appended claims.

What is claimed is:

1. A sedimentation centrifuge, comprising:

an elongated, hollow, rotatable, solid-wall bowl adapted to receive a mixture of light liquid, heavy liquid and solids, said bowl being rotatable about a longitudinally extending axis, said bowl having a cylindrical section having first and second axial ends, said bowl having first and second, coaxial, truncated conical, canted sections connected in series with each other, said first canted section extending away from said first end of said cylindrical section, said second canted section being adjacent to and extending away from said first canted section, said first and second canted sections each having a tapered wall, said tapered walls each extending at an acute angle to the axis of rotation of said bowl, said tapered wall of said first canted section being tapered at a larger angle than said tapered wall of said second canted section, said bowl having a first outlet for solids at an axially outer end of said second canted section, said bowl having second and third outlets for light liquid and heavy liquid, respectively, at said second end of said cylindrical section; a rotatable, helical screw conveyor rotatably mounted inside said bowl and extending substantially the full length thereof, said screw conveyor having a screw flight which is inclined with respect to the axis of rotation of said bowl and conforms to said cylindrical section and said canted sections; a plurality of helical fins mounted on said screw conveyor and extending parallel to and being positioned between the turns of said screw flight, said fins being straight in a direction from a radially innermost edge to a radially outermost edge thereof; a coaxial supply pipe inside said conveyor and hole means extending from said pipe for feeding the mixture into said cylindrical section of said bowl at a location close to said first end of said cylindrical section, a first zone extending from said location to the axially outer end of said second canted section being free of fins, a second zone extending from said location to said second axial end of said cylindrical section containing said fins.

2. A sedimentation centrifuge as claimed in claim 1 in which said fins have radially outer tips which are positioned from the wall of said cylindrical section a distance of from 5 mm to 100 mm, each of said fins has a thickness of from 0.5 to 2 mm and said fins being inclined with respect to the axis of rotation of the bowl at an angle in the range of from 30° to 85° degrees.

3. A sedimentation centrifuge, comprising:

an elongated, hollow, rotatable, solid-wall bowl adapted to receive a mixture of a liquid and solids, said bowl being rotatable about a longitudinally extending axis, said bowl having a cylindrical section having first and second axial ends, said bowl having first and second, coaxial, truncated conical, canted sections connected in series with each other, said first canted section extending away from said first end of said cylindrical section, said second canted section being adjacent to and extending away from said first canted section, said first and second canted sections each having a tapered wall, said tapered walls each extending at an acute angle to the axis of rotation of said bowl, said tapered wall of said first canted section being tapered at a larger angle than said tapered wall of said second canted section, said bowl having a first outlet for solids at an axially outer end of said second canted section, said bowl having a second outlet for liquid at said second end of said cylindrical section; a rotatable, helical screw conveyor rotatably mounted inside said bowl and extending substantially the full length thereof, said screw conveyor having a screw flight which is inclined with respect to the axis of rotation of said bowl and conforms to said cylindrical section and said canted sections; a plurality of helical fins mounted on said screw conveyor and extending parallel to and being positioned between the turns of said screw flight, said fins being straight in a direction from a radially innermost edge to a radially outermost edge thereof; a coaxial supply pipe inside said conveyor and hole means extending from said pipe for feeding the mixture into said cylindrical section of said bowl at a location close to said first end of said cylindrical section, a first zone extending from said location to the axially outer end of said second canted section being free of fins, a second zone extending from said location to said second axial end of said cylindrical section containing said fins.

* * * * *